US006314236B1

(12) United States Patent
Taylor

(10) Patent No.: US 6,314,236 B1
(45) Date of Patent: Nov. 6, 2001

(54) CORDLESS DRYER SAFETY INTERLOCK SYSTEM

(75) Inventor: Harold R. Taylor, Stratford, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 09/491,905

(22) Filed: Jan. 27, 2000

(51) Int. Cl.[7] ..... A45D 20/00

(52) U.S. Cl. ..... 392/385; 34/97; 361/2; 320/115; 200/50.31; 200/50.01

(58) Field of Search ..... 392/384, 385; 34/96–101; 219/242, 240, 256, 259, 481; 361/3, 1, 2; 307/142; 200/50.01–50.02, 50.03, 50.06, 50.28, 50.31, 293.1, 318, 318.1–318.2, 332.2, 61.85; 320/114–115

(56) References Cited

U.S. PATENT DOCUMENTS

| | | | | |
|---|---|---|---|---|
| 4,346,419 | * | 8/1982 | Janniello | 361/2 |
| 4,422,130 | * | 12/1983 | Nomura | 362/183 |
| 4,556,782 | * | 12/1985 | Fujishima et al. | 392/384 |
| 4,670,701 | * | 6/1987 | Sako et al. | 320/115 |
| 4,757,183 | | 7/1988 | Karey et al. . | |
| 4,910,385 | * | 3/1990 | Shye-Long | 392/384 |
| 4,947,514 | * | 8/1990 | Gerke, Jr. et al. | 15/339 |
| 5,195,253 | | 3/1993 | Poumey et al. . | |
| 5,233,283 | * | 8/1993 | Kennedy | 320/115 |
| 5,394,620 | | 3/1995 | Chimera . | |
| 5,602,458 | * | 2/1997 | Dowe | 320/115 |
| 5,631,959 | * | 5/1997 | Messina, Jr. et al. | 379/428 |

FOREIGN PATENT DOCUMENTS

| | | | | |
|---|---|---|---|---|
| 3429319 | * | 2/1986 | (DE) . | |
| 2131686 | * | 6/1984 | (GB) | 392/382 |
| 2299755 | * | 10/1996 | (GB) | 392/385 |
| 5-251137 | * | 9/1993 | (JP) . | |
| 99-01049 | | 1/1999 | (WO) . | |

* cited by examiner

*Primary Examiner*—John A. Jeffery
(74) *Attorney, Agent, or Firm*—Ohlandt, Greeley, Ruggiero & Perle, LLP

(57) ABSTRACT

A hair dryer having a heater, a fan positioned to form an air flow that is heated by the heater, a battery and a switch connected in circuit with the fan and the battery. An interlock prevents the switch from closing during the time the hair dryer is inserted in a base for charging the battery and heating the heater via an electrical power source. An arc prevention assembly prevents arcing among contacts on the hair dryer and the base during insertion and removal of the dryer to and from the base.

8 Claims, 4 Drawing Sheets

CORDLESS DRYER SAFETY INTERLOCK SYSTEM

FIELD OF THE INVENTION

This invention relates to a hair dressing appliance and, in particular, to a portable hair dryer that is usable without an electrical cord.

DESCRIPTION OF THE ART

U.S. Pat. No. 4,757,183 discloses a cordless portable hair dryer that has heater and a fan that forms an air stream that is heated by the heater. The portable hair dryer includes a battery for operating the fan and an electrical resistor that heats the heater. When not in use, the hair dryer is seated in a base that supplies electrical power to recharge the battery and to cause the resistor to heat the heater. International Patent Publication No. WO 99/01049 discloses a similar cordless portable hair dryer in which, when seated in the base, the battery and resistor are separately powered. The portable hair dryers disclosed by these patents do not include safety features that assure against operation of the fan when the dryer is seated in the base or against arcing upon insertion or removal of the dryer from the base.

An objects of the present Invention is to provide a cordless portable hair dryer with an interlock that prevents operation of the fan while the dryer is seated in the base.

Another object of the present invention is to provide a cordless portable hair dryer with means that prevent arcing during insertion and/or removal of the dryer from the base.

SUMMARY OF THE INVENTION

A hair dryer according to the invention has a heater, a fan positioned to form an air flow that is heated by the heater, a battery, and a trigger operated switch connected in circuit with the fan and the battery. When the hair dryer is seated in a base, an electrical source charges the battery and heats the heater. Manual operation of the trigger causes the switch to connect or disconnect the fan to the battery when the hair dryer is unseated from the base. An interlock prevents the switch from being closed when the hair dryer is seated in the base, thereby preventing the fan and heater from operating when the hair dryer is so disposed.

The hair dryer includes a handle that is insertable into and removed from the base. The interlock includes a pin and spring. The pin occupies a first position that prevents the closing of the switch to connect the fan to the battery when the hair dryer is seated in the base. The pin occupies a second position when the hair dryer is separated from the base. In this position, the pin permits the closing and opening of the switch to connect and disconnect the fan to and from the battery.

Another aspect of the invention is an arc prevention assembly that prevents arcing between a first plurality of contacts disposed on the handle and a second plurality of mating electrical contacts disposed on the base during insertion and removal of the handle to and from the base.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF INVENTION

Figure 1:
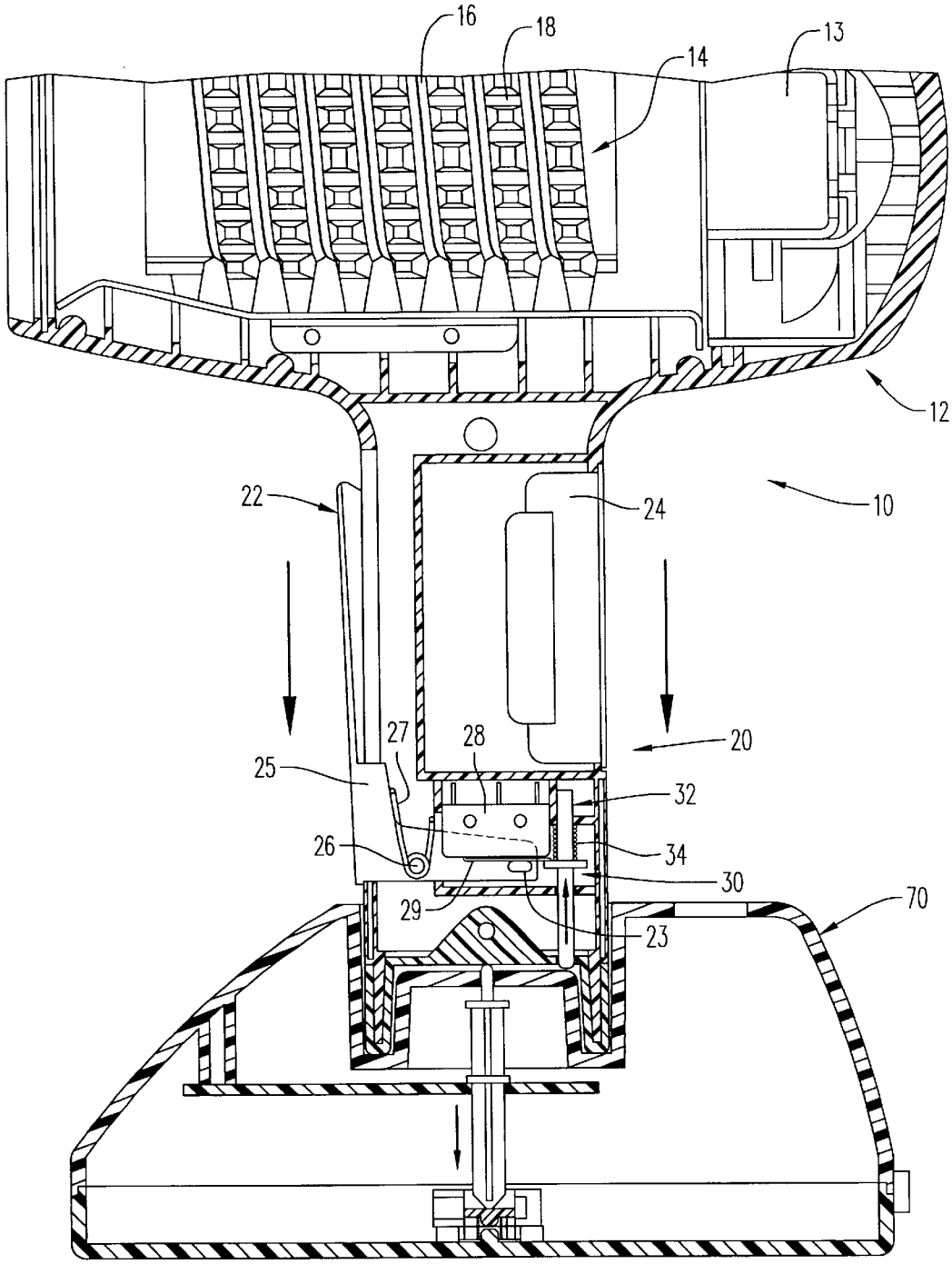
FIG. 1 is a partial elevational view of a portable hair dryer with cover removed according to the present invention.

Referring to FIG. 1, a portable hair dryer 10 includes an air flow generating portion 12 (shown in part), a handle 20 and a base 70. A fan 13 and a heater 14 are located in air flow generating portion 12. Heater 14 includes an electrical resistor 16 and a ceramic heating body 18. When handle 20 is inserted into base 70, electrical resistor 16 is supplied with electrical power and heats ceramic heating body 18. Air flow generating portion 12, heater 14 and fan 13 are shown in part.

An operator trigger 22 is located along side of handle 20. A battery 24, a switch 28 with a switch lever 29 and an interlock 30 are located in handle 20 Switch 28 includes a spring (not shown) that biases switch lever 29 to an open position in which its switch contacts (not shown) are opened.

Figure 2:
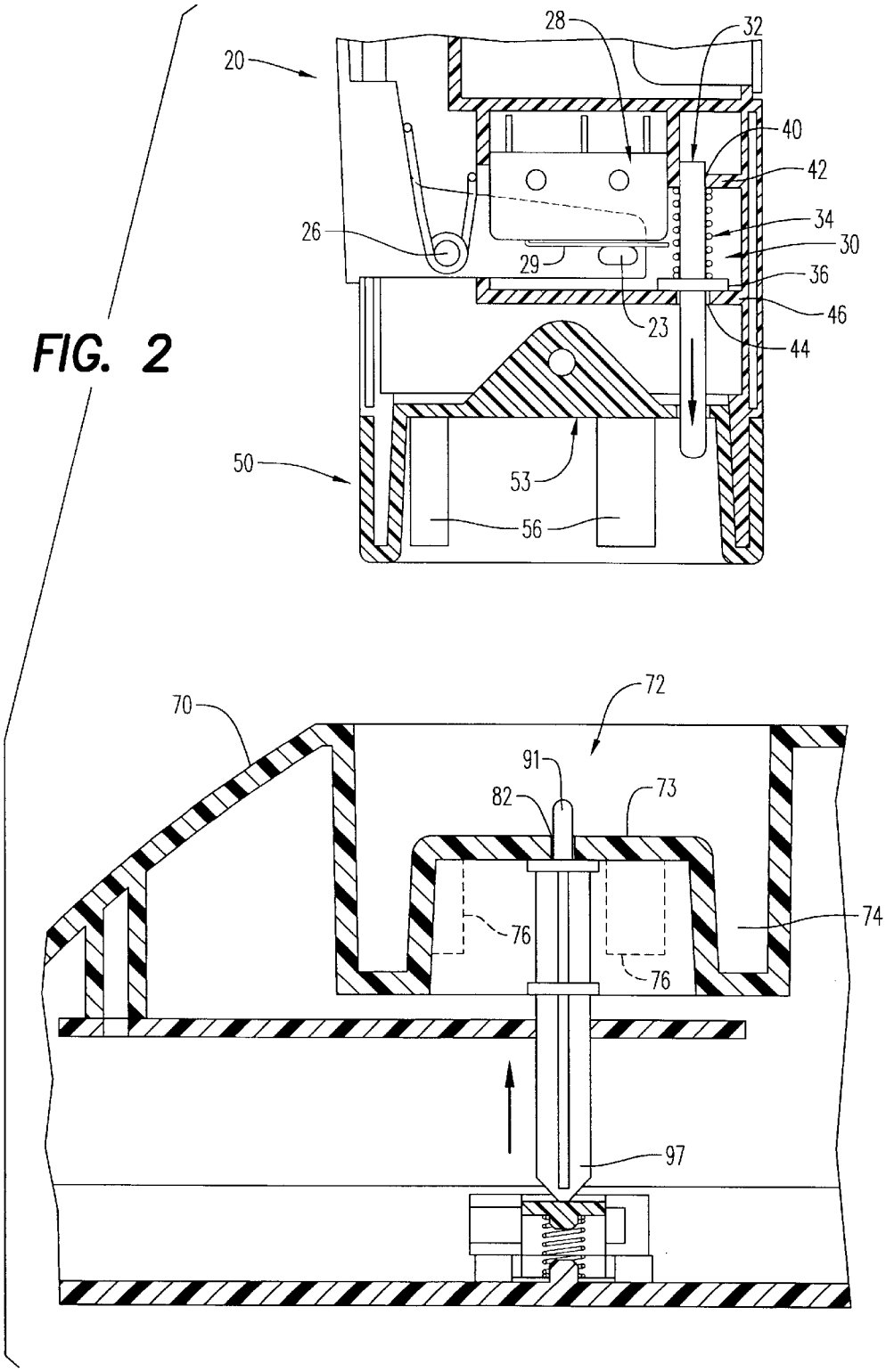
FIG. 2 is an enlarged view of portions of the base and handle of FIG. 1 when the hair dryer is separated from the base.

Operator trigger 22 has an L-shaped bottom plate 25 that is rotatable about a pivot 26. Trigger 22 is normally biased away from handle 20 by a sorina 27 to an open position that is shown in FIG. 1. Bottom plate 25 includes a boss 23 that engages switch lever 29 and biases it in a counter clockwise direction to an open position. Referring to FIG. 2, handle 20 of hair dryer 10 is shown separated from base 70. When trigger 22 is squeezed, bottom plate 25 rotates about pivot 26 and causes boss 23 and switch lever 29 to rotate clockwise to close switch 28, thereby connecting fan 16 to battery 24. When powered by battery 24, fan 13 generates an air flow that is heated by heater 14.

Figure 3:
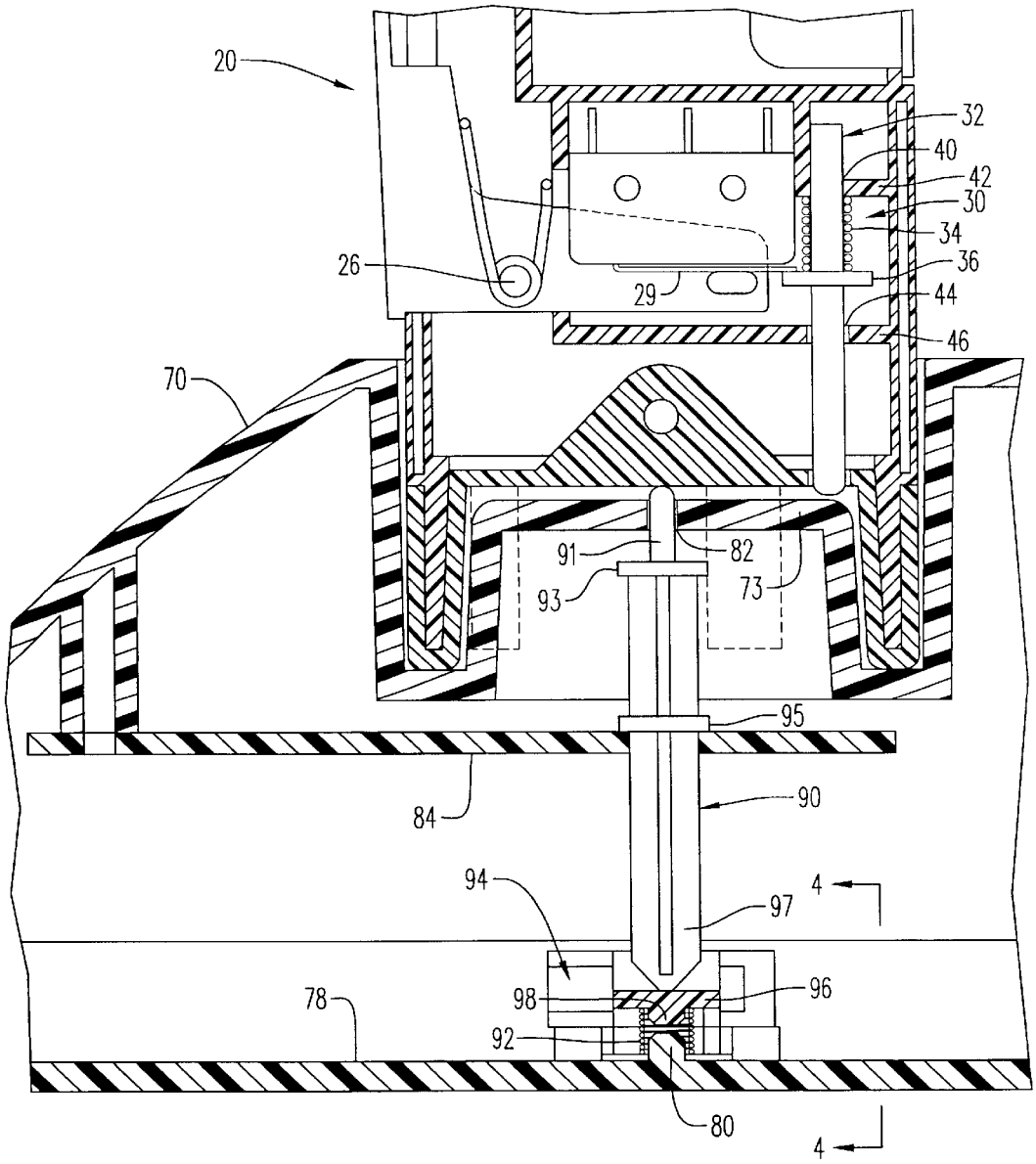
FIG. 3 is an enlarged view of portions of the base and handle of FIG. 1 when the hair dryer is seated in the base.

Referring to FIGS. 1 through 3, interlock 30 includes a pin 32, a spring 34 and a spring stop 36 that are best seen in FIG. 3. Pin 32 is arranged for vertical motion in an aperture 40 in an upper support member 42 and an aperture 44 in a lower support member 46. Upper support member 42 and lower support member 46 are integral to handle 20. Spring 34 is concentric about the portion of pin 32 that is between spring stop 36 and upper support member 42. Interlock 30 is shown in FIG. 2 in a "dryer-in-use" position in which spring 32 biases spring stop 36 against lower support member 46. In this position, interlock 30 has no effect on the opening and closing of switch 28 by trigger 22.

Referring to FIG. 3, interlock 30 is shown in the dryer charging position in which handle 20 is seated in base 70. During insertion into base 70, the bottom of pin 32 engages a central plate 73 in base 70 such that pin 32 is moved upward against the force of spring 34 to a position where spring stop 36 engages and maintains switch lever 29 in the open position. In this position, if trigger 22 is squeezed, boss 27 rotates clockwise, but switch lever 29 is prevented from rotating by spring stop 36, thereby keeping switch 28 in the open position. Hence, if trigger 22 is squeezed when dryer 10 is seated in base 70 in the charging position, switch 28 remains open and fan 13 cannot be connected to battery 24.

Referring to FIG. 2, base 70 includes a handle receptacle 72 that includes central plate 73 surrounded by an annular well 74 for receiving a mating annulus 50 carried on the bottom of handle 20. Mating annulus 50 surrounds a plate 53. A plurality of base contacts 76 are disposed on the inner periphery of annular well 74, of which only two are shown in FIG. 2. A plurality of mating dryer contacts 56 are disposed on the interior wall of annulus 50.

Referring to FIG. 3, for prevention of arcing as handle 20 is inserted into and/or removed from base 70, a pin 90 and spring 92 are provided to control the opening and closing of a switch 94. When switch 94 is open no electrical power is provided to contacts 76. When switch 94 is closed, electrical power is provided to contacts 76.

Pin 90 and spring 92 are arranged to keep switch 94 open during insertion and removal of handle 20 to prevent arcing between contacts 76 and 56. To this end, spring 92 is situated vertically between a bottom 78 of base 70 and a switch lever 96 of switch 94. In particular, one end of spring 92 is concentrically positioned on a boss 80 that projects upwardly from base 78. The other end of spring 92 is positioned vertically on a boss 98 that projects downwardly from switch lever 96.

Pin 90 has a nipple 91 on its upper end that is positioned for travel in an aperture 82 along a length defined by stops 93 and 95. Pin 90 is in vertical alignment with spring 92 and has a bottom 97. When handle 20 is separated from base 70, spring 92 is fully extended and forces pin 90 to the position shown in FIG. 2 with stop 93 resting against the bottom of central plate 73 and nipple 91 projecting above the top surface of central plate 73. Bottom end 97 of pin 90 is high enough so that switch lever 96 is rotated clockwise to an open position 96A as best seen in FIG. 4.

Figure 4:
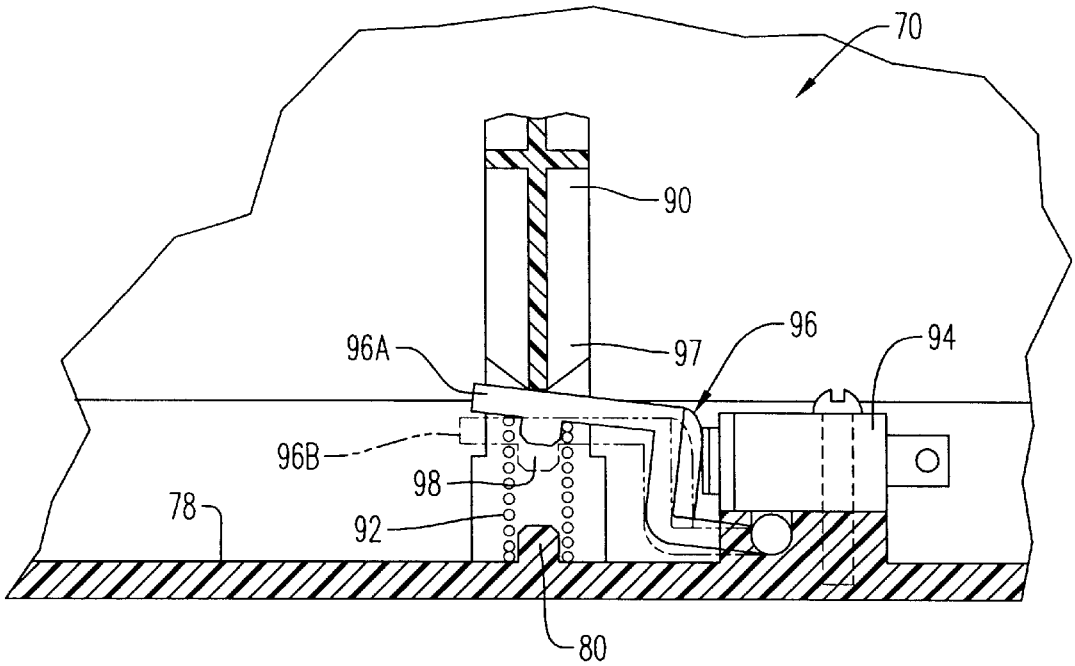
FIG. 4 is a view taken along line 4—4 of FIG. 3.

With reference to FIGS. 3 and 4, when handle 20 is inserted in base 70, nipple 91 is pushed downward by central plate 53 of handle 20, thereby pushing pin 90 downwardly to the position shown in FIG. 3. In this position, stop 95 rests against a base support 84 and bottom end 97 is engaged with switch lever 96 to compress spring 92. As best seen in FIG. 4, switch lever 96 is rotated to a closed position 96B.

Pin 90, stops 93 and 95, base support 84, and spring 96 are dimensioned such that there is substantially no arcing during insertion and removal of handle 20 to and from base 70. Thus, during insertion switch lever 96 does not reach its closed position until electrical contacts 56 and 76 are substantially engaged. During removal contacts 56 and 76 are substantially disengaged before switch lever 96 reaches its open position.

The present invention having been thus described with particular reference to the preferred forms thereof, it will be obvious that various changes and modifications may be made therein without departing from the spirit and scope of the present invention as defined in the appended claims.

What is claimed is:

1. A hair dryer having a heater, a fan positioned to provide an air flow that is heated by the heater, a battery, and a switch connected in circuit with the fan and the battery, the battery being chargeable via an electrical source when the hair dryer is seated in a base, said hair dryer comprising:

a handle that can be inserted into and removed from the base;

a manually operated trigger for operating the switch to connect and disconnect the fan and the battery when the handle is unseated from the base, means for interlocking the fan and the battery, said means for interlocking including a pin and being responsive to the handle being seated in the base to physically prevent the switch from being closed, thereby preventing the fan from operating when the handle is seated in the base.

2. The hair dryer of claim 1, further comprising an arc prevention assembly dimensioned to prevent arcing between a first plurality of contacts disposed on the handle and a second plurality of mating electrical contacts disposed on the base.

3. The hair dryer of claim 2, wherein the arc prevention assembly includes a second switch that is located in the base and that, when closed, connects the second plurality of contacts with the source of electrical power, and wherein the arc prevention assembly is dimensioned so that the second switch does not close during insertion of the handle until the first plurality of contacts is in substantial electrical contact with the second plurality of contacts and so that the second switch opens during removal of the handle while the first plurality of contacts is in substantial electrical contact with the second plurality of contacts.

4. The hair dryer of claim 3, wherein the arc prevention assembly further includes a pin and a spring that are adapted to open and close the second switch, the pin travels between a first position at which the second switch is open and a second position at which the second switch is closed during insertion and removal of the handle to and from the base, respectively, and wherein the spring biases the pin to the first position during removal.

5. A hair dryer having a heater, a fan positioned to provide an air flow that is heated by the heater, a battery, and a switch connected in circuit with the fan and the battery, the battery being chargeable via an electrical source when the hair dryer is seated in a base, said hair dryer comprising:

a manually operated trigger for operating the switch to connect and disconnect the fan and the battery when the hair dryer is unseated from the base; and means for interlocking the fan and the battery, said means for interlocking including a pin and being responsive to the hair dryer being seated in the base to physically prevent the switch from being closed, thereby preventing the fan from operating when the hair dryer is seated in the base.

6. The hair dryer of claim 5, wherein said means for interlocking further comprises a spring.

7. The hair dryer of claim 6, wherein seating the hair dryer in the base engages the pin with the base, thereby positioning the pin to prevent the switch from connecting the fan and the battery, and wherein the hair dryer is not seated in the base, the spring biases the pin to a position to permit the switch to connect the fan and the battery.

8. The hair dryer of claim 5, wherein seating the hair dryer in the base engages the pin with the base, thereby positioning the pin to prevent the switch from connecting the fan and the battery, and wherein the hair dryer is not seated in the base, the pin is positioned to permit the switch to connect the fan and the battery.

* * * * *